US006712592B2

(12) United States Patent
Faulenbach et al.

(10) Patent No.: US 6,712,592 B2
(45) Date of Patent: Mar. 30, 2004

(54) YAM MELT SPINNING APPARATUS

(75) Inventors: Bernd Faulenbach, Leichlingen (DE); Detlev Schulz, Radevormwald (DE)

(73) Assignee: Barmag AG, Remscheid (DE)

( * ) Notice: Subject to any disclaimer, the term of this patent is extended or adjusted under 35 U.S.C. 154(b) by 0 days.

(21) Appl. No.: 10/226,495

(22) Filed: Aug. 23, 2002

(65) Prior Publication Data

US 2003/0012835 A1 Jan. 16, 2003

Related U.S. Application Data

(63) Continuation of application No. PCT/EP01/04219, filed on Apr. 12, 2001.

(30) Foreign Application Priority Data

Apr. 18, 2000 (DE) ..... 100 19 024

(51) Int. Cl.[7] ..... D01D 5/092

(52) U.S. Cl. ..... 425/72.2; 425/378.2; 425/464; 425/DIG. 47

(58) Field of Search ..... 425/72.2, 378.2, 425/382.2, 464, DIG. 47

(56) References Cited

U.S. PATENT DOCUMENTS

| | | | | |
|---|---|---|---|---|
| 2,927,029 | A * | 8/1960 | Bakker | 425/72.2 |
| 3,659,980 | A | 5/1972 | Fernandez | 425/72.2 |
| 4,681,522 | A | 7/1987 | Lenk | 425/72.2 |
| 2001/0015508 | A1 | 8/2001 | Schafer et al. | 264/101 |
| 2001/0033037 | A1 | 10/2001 | Nitschko et al. | 264/403 |

FOREIGN PATENT DOCUMENTS

| | | | |
|---|---|---|---|
| DE | 3406347 | A1 | 10/1984 |
| EP | 0 172 556 | A2 | 2/1986 |
| JP | 406158416 | A * | 6/1994 |
| WO | WO 99/67450 | | 12/1999 |

* cited by examiner

*Primary Examiner*—Robert Davis
*Assistant Examiner*—Joseph S. Del Sole
(74) *Attorney, Agent, or Firm*—Alston & Bird LLP

(57) ABSTRACT

A spinning apparatus for melt spinning a synthetic multifilament yarn, which includes a spin head having a plurality of narrowly spaced apart spin packs with spinnerets, through the nozzle bores of which the filaments are extruded. Downstream of the spinnerets, the filaments advance through cooling tubes, which connect to an air stream generator that produces an air stream in the direction of the advancing yarn. The cooling tubes are mounted for movement to a lowered servicing position, and sealing units are provided for connecting the cooling tubes to the spin head when in the raised operative position. The sealing units form a separating plane arranged on the side of the spin head and a separating plane arranged on the side of the cooling tube, and the separating plane on the spin head side is located on the spin pack. A very compact arrangement of the spin head and the cooling tubes is thereby enabled.

17 Claims, 4 Drawing Sheets

YAM MELT SPINNING APPARATUS

CROSS REFERENCE TO RELATED APPLICATION

This is a continuation of copending application PCT/EP01/04219, filed Apr. 12, 2001, and designating the U.S.

BACKGROUND OF THE INVENTION

The invention relates to a spinning apparatus for melt spinning and cooling endless synthetic multifilament yarns.

In the production of synthetic multifilament yarns, a molten polymer is extruded to a plurality of strandlike filaments. To this end, the polymer melt is advanced by means of a pump via lines to one or more spin packs. Besides filter and distributor elements, the spin packs comprise a spinneret with a plurality of bores. The pump, lines, and spin packs are accommodated in a heated spin head. After cooling the filaments, which are extruded through the bores of the spinneret, by means of a cooling device, for example an air stream, the filament bundles are combined to respectively one yarn, and the yarn undergoes further treatment. In most cases a spin head accommodates four, six, or more spin packs in a narrowly spaced relationship in one row.

It has been found advantageous to guide the air stream that cools the filaments, together with the filaments and parallel to the filaments, at a high flow velocity through a cooling tube. An apparatus for carrying out such a method is described, for example, in WO 99/067450 and corresponding U.S. Patent Application Publication 2001/0033037. In this apparatus, a suction fan is provided at the end of the cooling tube for maintaining the required flow velocity. At the upper end of the cooling tube, the cooling air is supplied to the cooling tube through a screen cylinder.

In this connection, the need arises for sealing the connection from the cooling tube to the spin head against ambient air in a separable manner for purposes of avoiding the inflow of secondary air. In so doing, it should be noted that the spinnerets accommodated in the spin packs are arranged in a very narrowly spaced relationship. The reason therefore lies on the one hand in that the available assembly space in the spin head is limited. On the other hand, the spinnerets and the spin packs connected thereto have a large diameter, in particular in the case large numbers of filaments.

DE 34 06 347 A1 discloses a possibility of sealingly connecting a cooling tube with an air chamber surrounding it to the spin head such that the cooling tube and the air chamber can be lowered for servicing procedures. To this end, DE 34 06 347 A1 provides on the side of the spin head and on the side of the cooling tube flanges, between which a sealing means and a heat insulating means are provided. The heat insulating means prevents heat from flowing out of the spin head into the spin shaft. The sealing means interconnects the spin head and the cooling tube in an airtight manner, and it is designed and constructed for separation.

Because of the flanges on the spin head side, the teaching described in DE 34 06 347 A1 cannot be applied to spin heads with spin packs arranged in a very narrowly spaced relationship. On the other hand, impermeability to gas between spin head and spin pack is not ensured in all types of spin heads. In such a case, cooling air would be pulled through the spin head, and the latter be cooled in an unacceptable manner.

It is therefore an object of the invention to further develop the seal between the spin head and the cooling tube such that a seal can also be used in spin heads with spin packs arranged in a very narrowly spaced relationship, as well as in types of spin heads, which are not made gastight between the spin head and the spin pack.

SUMMARY OF THE INVENTION

In accordance with the invention, the above and other objects are achieved in that a separating plane of the sealing unit located on the side of the spin head is arranged on the spin pack.

As a result of the invention, it is possible to realize a cooling device in alignment with a filament bundle even in the case of very compact spin heads with a correspondingly narrow spacing between the spin packs. The separation between the spin pack and the cooling tube is sealed by the sealing unit in an advantageous manner against secondary air, with the sealing unit also covering the underside of the spin pack. Both the separating plane on the spin head side and the separating plane on the cooling tube side are configured such that after each separation, the impermeability of the sealing unit remains substantially unchanged. The sealing unit is understood to include all means, which are necessary to connect a cooling tube to a spin pack in a sealable manner.

A special advantage of the invention lies in that the cooling tubes are constructed with a smaller diameter and, thus, can also be arranged in a narrowly spaced relationship, and that the sealing unit may be used even in spin heads that are not gastight.

To arrange the spin packs inside the spin head with the smallest possible spacing between one another for a particularly narrow spacing between the spinning positions, it is preferred to design and construct the spinning apparatus of the present invention with the sealing unit being located substantially within the peripheral boundary that is defined by the cross section of the spin pack.

In another advantageous further development of the invention, the separating plane located on the spin head side is arranged directly on the spinneret. This permits the realization of still narrower dimensions of the spacing in comparison with the above described construction.

In a particularly advantageous further development of the invention, the separating plane on the spin head side is arranged on a fastening member for the spin pack or on a fastening member for the spinneret. This allows further assembly space to be saved, and to achieve an especially narrow spacing between the spin packs.

To permit the sealing unit between the spin pack and the cooling tube to be removed as far as possible from the underside of the spin pack, it is possible to arrange the separating plane on the spin head side on an end face of an annular collar which projects from the underside of the spin pack. This reduces the inflow of heat from the spin pack into the sealing unit to a great extent, so that the sealing unit need not have a resistance to extreme temperatures.

Advantageously, the separating plane arranged on the cooling side is formed directly on the end of the cooling tube facing the spin head.

However, in many cases it is necessary that no significant amount of heat be removed from the spin pack or spinneret via the connection to the cooling tube. This would lower the temperature of the melt in a disadvantageous manner. For this reason, an advantageous further development of the invention provides for a thermal separation of the cooling tube. This occurs by insulating the sealing unit against heat.

According to a particularly advantageous further development of the invention, the insulating and sealing functions may be separated from each other. To this end, the sealing unit comprises an insulating member for the heat insulation, and a separate sealing element for the sealing.

In a particularly favorable embodiment, the insulation is arranged on the heated side, i.e., in facing relationship with the spin head. This permits lowering the temperature level of the seal, so that it is also possible to use temperature sensitive materials for the seal. The temperature level of the seal can be further lowered by placing a heat dissipating member between the insulation and the seal.

BRIEF DESCRIPTION OF THE DRAWINGS

In the following, an embodiment is described in greater detail with reference to the attached drawings, in which.

DETAILED DESCRIPTION OF THE PREFERRED EMBODIMENTS

Figures 1, 1A:
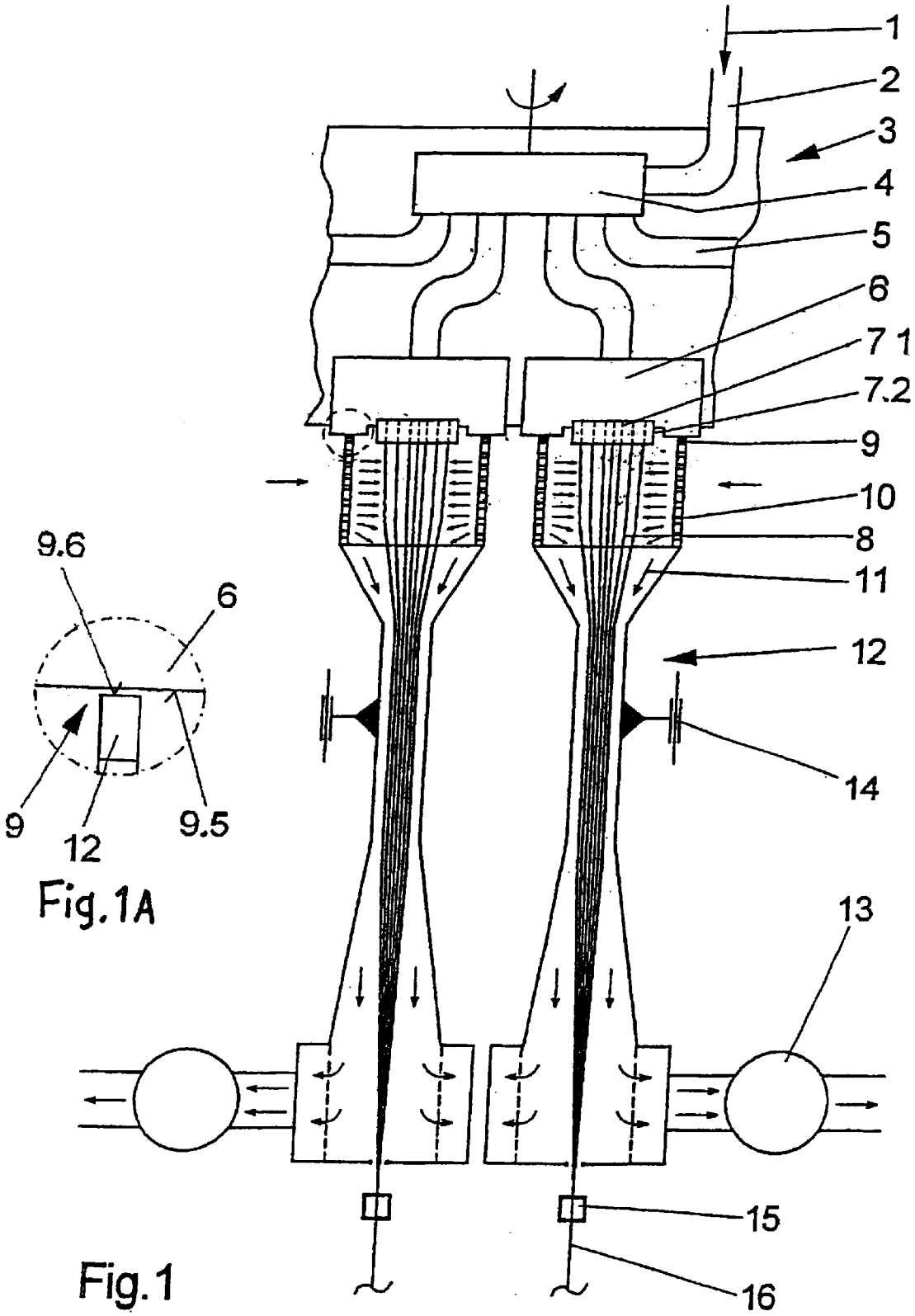
FIG. 1 is an illustration of the spinning apparatus according to the invention.
FIG. 1A is an enlarged view of the portion of the apparatus located within the dashed line circle in FIG. 1.

FIG. 1 illustrates a spinning apparatus of the present invention. A melt 1 is advanced via a melt line 2 to a heated spin head 3. The spin head accommodates a booster and distributor pump 4, which distributes the supplied melt via distributor lines 5 to spin packs 6. For reasons of simplification, the drawing is a cutout view showing only two spin packs. Normally, six, eight, or more spin packs are arranged side by side in a narrowly spaced relationship.

Besides elements for filtering and distributing the melt, the spin pack 6 mounts on its underside a spinneret 7.2, through which the melt 1 is extruded to filaments 8 by passing through a plurality of nozzle bores 7.1.

The filaments 8 are advanced through a cooling tube 12 together with a cooling air 11 that is delivered by means of an air stream generator 13. The cooling air 11 enters through the upper region of cooling tube 12. To this end, the upper region of the cooling tube 12 is formed by a gas permeable screen cylinder 10. At the front end of the cooling tube 12 and downstream of spin pack 6, an annular sealing unit 9 is formed. The sealing unit 9 assists in preventing secondary air from entering between spin pack 6 and cooling tube 12, and from leading to an undesired cooling of spin pack 6 or filaments 8 directly after their emergence from spin pack 6.

After their cooling, the filaments 8 leave the cooling tube 12 through a lower opening. They are combined by means of a lubrication device 15 to a yarn 16, which is subsequently further processed and wound.

To ensure accessibility to spin pack 6 for servicing operations, the entire cooling tube 12 can be lowered by means of a lifting device 14. When lowering cooling tube 12, the sealing unit 9 is separated along a parting line formed by a separating plane located on the spin head side and a separating plane located on the cooling tube side. In the following Figures, the separating plane on the spin head side is indicated at numeral 9.5 and the separating plane on the cooling tube side at numeral 9.6.

As best seen in FIG. 1A, the sealing unit 9 is defined by a first surface lying within the separating plane 9.5 on the spin pack 6, and a parallel second surface lying within the separating plane 9.6 on the cooling tube 12, and with the first and second surfaces being in face to face engagement when the cooling tube is in its operative position.

Figure 2:
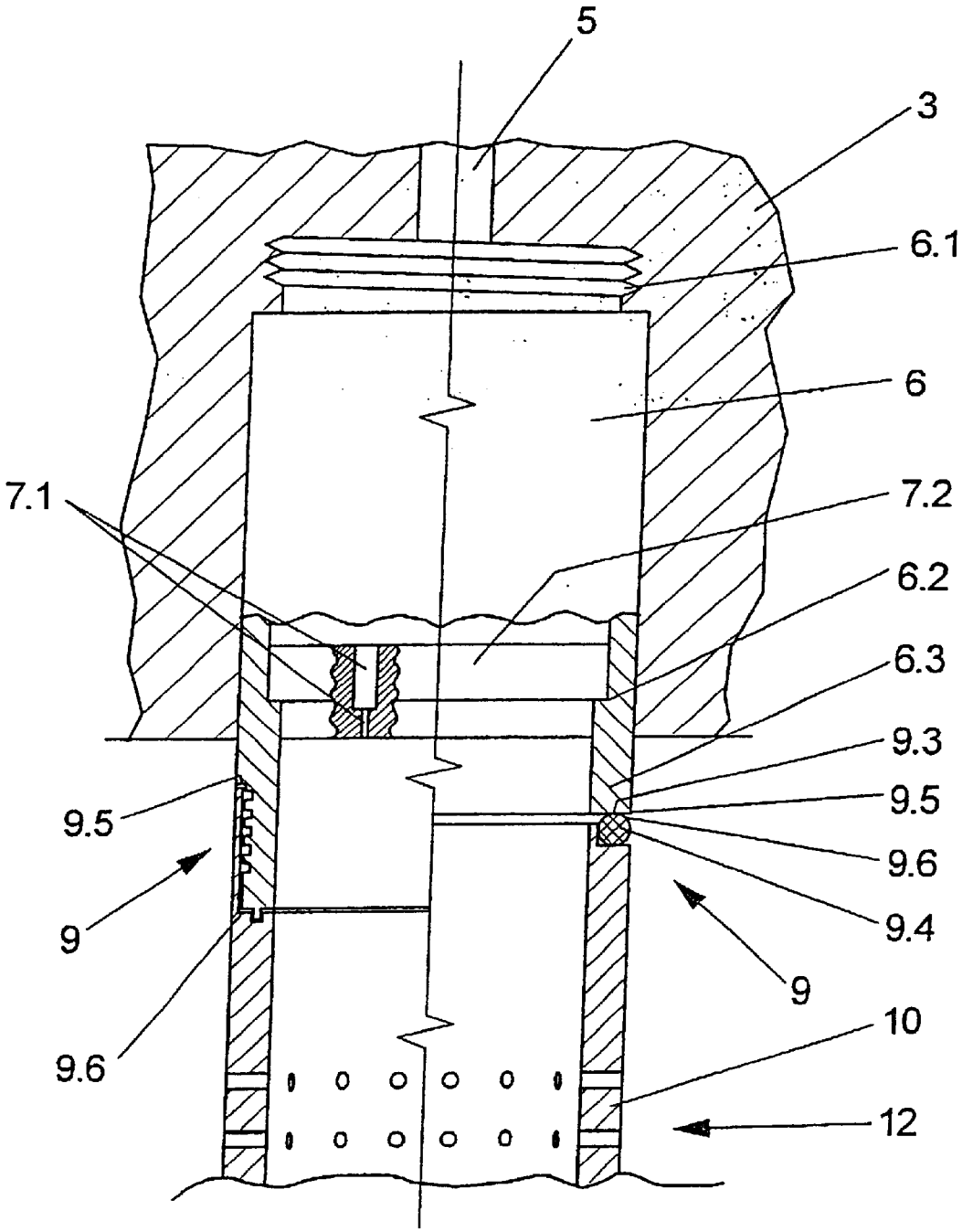
FIG. 2 is a detail view of a spin pack with two variants of a sealing unit.

FIG. 2 is a detail view of exchangeable spin pack 6 and a variant of separable sealing unit 9.

The melt is delivered via distributor line 5 to spin pack 6. The exchangeable spin pack 6 is secured to spin head 3, for example, by means of a screw thread 6.1. Located in spin pack 6 is a spinneret 7.2. with bores 7.1. In the present embodiment, the spinneret 7.2 is supported on a step 6.2. On its underside, the spin pack 6 mounts a collar 6.3, which extends in this embodiment beyond the underside of spin head 3. However, it is also possible that this collar 6.3 is flush with the underside of the spin head, or that it extends into spin head 3. This is especially advantageous under the aspect that the collar leads to an undesired dissipation of heat.

On the right and the left side of the center line, two different sealing units 9 are shown by way of example.

On the right side of the illustration in FIG. 2, the collar 6.3 has on its underside a sealing surface 9.3, against which an annular seal 9.4 is pressed. In the present embodiment, the seal 9.4 is a heat resistant gasket with a poor heat conduction, which is made, for example, from a cord of ceramic fabric or from a silicone resistant to high temperatures. In FIG. 2, the gasket cord 9.4 is secured to cooling tube 12. In its illustrated operating position, the sealing unit 9 seals the cooling tube 12 against spin pack 6 in a gastight manner, so that the cooling air can enter the cooling tube 12 only through the gas permeable wall 10.

In the case of maintenance or service, the cooling tube 12 is lowered, and the sealing unit 9 is opened between separating planes 9.5 and 9.6, with the seal 9.4 remaining on the cooling tube 12. In this instance, the separating plane 9.5 on the side of the spin head is formed by a sealing surface 9.3 provided on the end face of collar 6.3. The separating plane 9.6 on the side of the cooling tube is formed by the upper side of seal 9.4.

The left side of the illustration in FIG. 2 shows a sealing unit, which is designed and constructed as a labyrinth seal. While such a seal does not seal in a gastight manner, it exhibits a very high resistance to flow against gas permeable cooling tube wall 10, so that only very small leakage air flows are to be expected. A heat insulation of cooling tube 12 against spin pack 6 occurs via the narrow air gap of the labyrinth. The separating plane 9.5 on the spin head side is likewise formed on projecting collar 6.3 of spin pack 6. Opposite thereto on the front end of cooling tube 12 is the separating plane 9.6 of the cooling tube side.

In addition to the gasket cord and labyrinth seal illustrated in the drawing, other sealing systems are also possible, which combine the functionality of heat insulation and/or of sealing action.

The embodiment illustrated in FIG. 2 is especially suited for spinning apparatus, wherein the spin packs are arranged inside the spin head at a very small distance from one another. Since the sealing unit 9 and the cooling tube 12 do not extend with their outer dimensions beyond the peripheral boundary defined by the cross section of spin pack 6, it is easy to apply the spacing between spin packs to the region of the cooling device by adapting the outside diameter of the cooling tubes to the spin pack.

Figure 3:
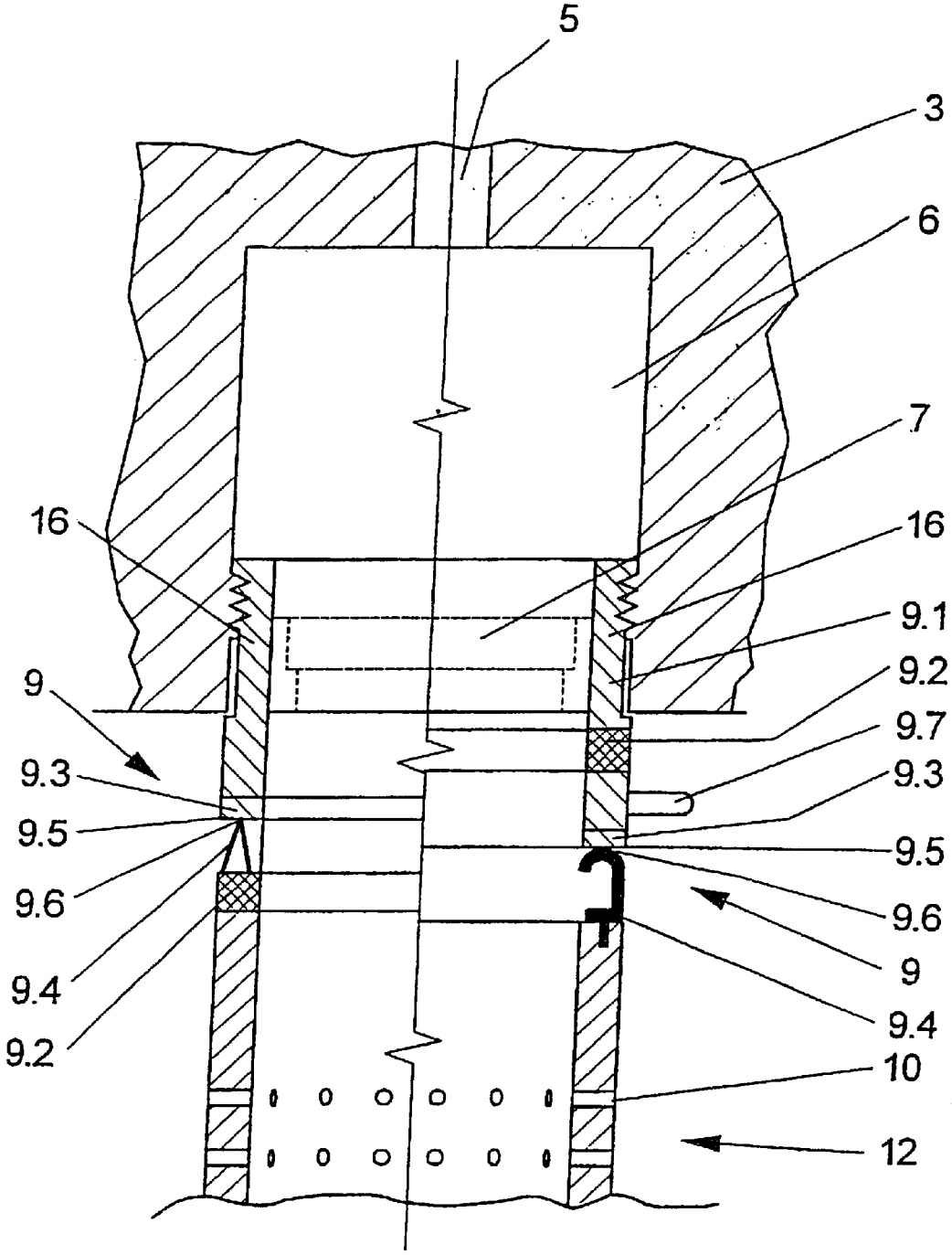
FIG. 3 is a detail view of a variant with a sealing unit designed and constructed as part of a fastening member.

FIG. 3 illustrates other particularly advantageous variants of the invention. Other than in the embodiment illustrated in FIG. 2, the exchangeable spin pack 6 is not directly screwed in, but held in spin head 3 by a separate fastening member 16. The fastening member is designed and constructed as a threaded sleeve 16, which is screwed with its one end into spin head 3, and has a collar 9.1 at its other end outside of spin head 3. In addition to the screw connection, it is also possible to use, for example, a bayonet joint. The collar 9.1 of threaded sleeve 16 also includes the elements of sealing unit 9, which remain during the separation on the spin head side above separating plane 9.5. This embodiment also explicitly includes variants, wherein the collar 9.1 ends flush with the underside of the spin head or extends into same.

In the example illustrated on the right side of FIG. 3, a separate insulating body 9.2 is integrated in the collar 9.1 as an annular ring. Below the insulating body 9.2, a sealing surface 9.3 is provided, against which an elastic seal 9.4 is pressed. Since in this example the heat insulation is provided on the heated side, it is also possible to use as seal a material that is not resistant to heat, such as, for example, a special-section seal of rubber or cork, which is in this instance secured to cooling tube 12. The special advantage of this arrangement is that only a small heat stream is able to flow through insulation body 9.2. On the sealing surface side 9.3 of the insulation, a portion of the heat stream is already dissipated. Moreover, to further enhance this effect, it is possible to provide on collar 9.1 between insulating body 9.2 and sealing surface 9.3, a cooling surface 9.7, for example, in the form of a cooling rib. As a result, the seal 9.4 is under only little thermal stress. The separating plane 9.5 on the spin head side is formed by the end face of collar 9.1, which is located opposite to separating plane 9.6 on the cooling tube side in the form of the upper side of the seal.

It is also possible to arrange the seal 9.4 below insulation 9.2 and to connect sealing surface 9.3 to cooling tube 12, so that during a separation the seal 9.4 remains on the spinning head side. In this instance, the separating plane of the spin head side would be formed on the underside the seal 9.4.

On the left side of the illustration in FIG. 3, the arrangements of seal 9.4 and of insulating body 9.2 are transposed. In this instance, a heat resistant gasket 9.4 is pressed against sealing surface 9.3. For example, a cutting ring is used as gasket. The sealing surface 9.3 includes a small groove. For the heat insulation, the insulating body 9.2 is integrated below gasket 9.4 as an annular ring in the cooling tube wall and prevents the heat from dissipating into cooling tube 12. The separating plane 9.6 on the cooling tube side is also formed by the upper side of seal 9.4. Accordingly, the separating plane 9.5 on the spin head side is formed by sealing surface 9.3 at the end of collar 9.1.

Figure 4:
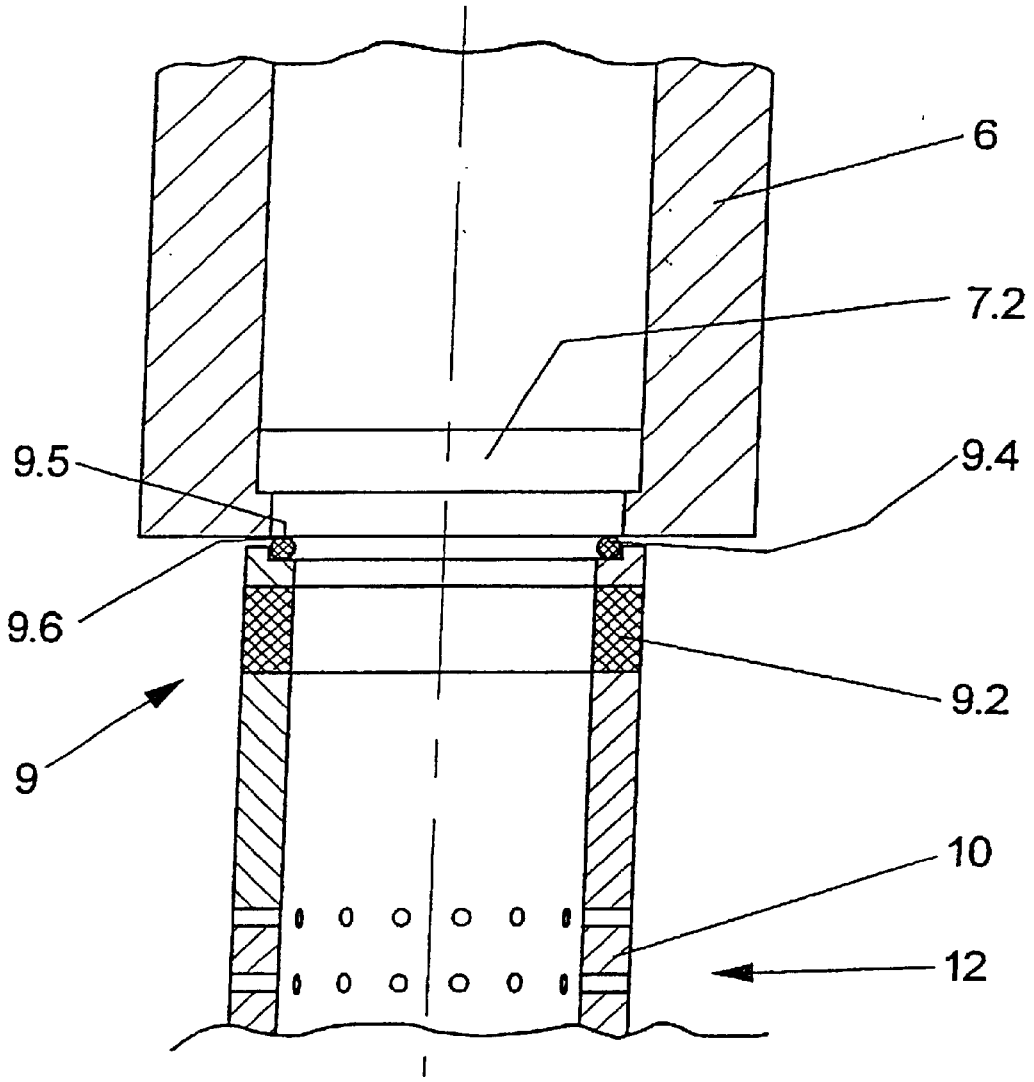
FIG. 4 is a detail view of a further variant.

FIG. 4 illustrates a further variant of the invention, wherein the cooling tube 12 is connected in sealing relationship to the spinneret 7.2. To this end, the seal 9.4 that is secured to cooling tube 12, is pressed against the underside of spinneret 7.2, which thus forms the separating plane on the spin head side. As described with reference to the left side of FIG. 3, the insulating body 9.2 is an annular ring arranged below seal 9.4 so as to form a portion of the wall of cooling tube 12.

The embodiments of the sealing unit as shown in FIGS. 2–4, can be optionally used in the embodiment of the spinning apparatus according to the invention as shown in FIG. 1. In this connection, it is insignificant, whether the cooling air in the surrounding outside of the cooling tube downstream of the spin head originates from a suction device connected to the end of the cooling tube or from a blower arranged downstream of the spin head. To this extent, the invention encompasses all spinning apparatus, wherein it is intended to prevent an air supply in a parting line between a spin pack and a cooling tube.

What is claimed is:

1. A spinning apparatus for melt spinning a synthetic multifilament yarn, comprising a spin head which mounts one or more spin packs, with each spin pack comprising a spinneret for forming a plurality of downwardly advancing filaments from a melt delivered thereto, a cooling tube arranged below each of the spin packs for receiving the advancing filaments and being connected to an air stream generator, and with the cooling tube being mounted for reciprocable movement extending in a direction substantially parallel to the downwardly advancing filaments between an operative position adjacent the spin head and a separated position which facilitates servicing, and a sealing unit configured to connect each cooling tube to the spin head in a sealing relationship when the cooling tube is in its operative position, with the sealing unit defining a separating plane arranged on the spin head side and a separating plane arranged on the cooling tube side, and wherein the separating plane on the spin head side includes a surface which is located on the spin pack.

2. The spinning apparatus of claim 1 wherein the sealing unit for each cooling tube is configured so as to lie inside a peripheral boundary which is defined by the cross section of the spin pack.

3. The spinning apparatus of claim 2 wherein said surface of the separating plane of the sealing unit which is arranged on the spin head side is located on the spinneret of the spin pack.

4. The spinning apparatus of claim 2 wherein each spin pack includes a fastening member for securing the spin pack to the spin head, and wherein the surface of the separating plane which is arranged on the spin head side is located on the fastening member.

5. The spinning apparatus of claim 4 wherein the fastening member is configured as a threaded sleeve.

6. The spinning apparatus of claim 2 wherein the surface of the separating plane arranged on the spin head side is located on an end face of an annular collar which projects from the underside of the spin pack.

7. The spinning apparatus of claim 2 wherein the separating plane arranged on the cooling tube side is formed on an end face of the cooling tube which is adjacent the spin head.

8. The spinning apparatus of claim 2 wherein the sealing unit comprises a heat insulating material to minimize heat loss from the spin pack toward the cooling tube.

9. The spinning apparatus of claim 2 wherein the sealing unit comprises a heat insulating member for thermal insulation and a separate gas sealing element.

10. The spinning apparatus of claim 9 wherein the heat insulating member is disposed between the separating plane arranged on the spin head side, and the spin pack.

11. The spinning apparatus of claim 9 further comprising a heat dissipating member disposed adjacent the heat insulating member or the gas sealing element.

12. The spinning apparatus of claim 9 wherein the heat insulating member is an annular ring which forms a portion of the cooling tube below the separating plane on the cooling tube side.

13. The spinning apparatus of claim 9 wherein the separate gas sealing member comprises an annular ring secured to the cooling tube and positioned to engage the spinneret, and the heat insulating member comprises an annular ring which forms a portion of the cooling tube and is located below the gas sealing member.

14. A spinning apparatus for melt spinning a synthetic multifilament yarn, comprising a spin head which mounts a plurality of spin packs, with each spin pack comprising a spinneret for forming a plurality of downwardly advancing filaments from a melt delivered thereto, a cooling tube arranged below each of the spin packs for receiving the advancing filaments and being connected to an air stream generator, and with the cooling tube being mounted for reciprocable movement extending in a direction substantially parallel to the downwardly advancing filaments between an operative position adjacent the spin head and a separated position which facilitates servicing, and a sealing unit configured to connect each cooling tube to the spin head in a sealing relationship when the cooling tube is in its operative position, and wherein the sealing unit comprises an annular seal which lies within a peripheral boundary of the spin pack.

15. The spinning apparatus of claim 14 wherein the sealing unit defines a separating plane arranged on the spin head and a parallel separating plane arranged on the cooling tube, and the annular seal is defined by a first surface lying within the separating plane on the spin head and a second surface lying within the separating plane on the cooling tube, and with the first and second surfaces being in face to face engagement when the cooling tube is in its operative position.

16. The spinning apparatus of claim 14 wherein the annular seal comprises a heat resistant gasket fixed to the cooling tube and positioned to engage the spin pack.

17. The spinning apparatus of claim 16 wherein the annular seal positioned to engage the spinneret of the spin pack, and the sealing unit further comprises an annular heat insulating body which forms a portion of the cooling tube and is located below the annular seal.

* * * * *

UNITED STATES PATENT AND TRADEMARK OFFICE

CERTIFICATE OF CORRECTION

PATENT NO. : 6,712,592 B2
APPLICATION NO. : 10/226495
DATED : March 30, 2004
INVENTOR(S) : Faulenbach et al.

It is certified that error appears in the above-identified patent and that said Letters Patent is hereby corrected as shown below:

Title page, Item [54], Column 1,

Line 1, in the title: "YAM" should read --YARN--.

Signed and Sealed this

Twenty-second Day of January, 2008

JON W. DUDAS
*Director of the United States Patent and Trademark Office*